US007425077B2

(12) United States Patent
Lockamy et al.

(10) Patent No.: US 7,425,077 B2
(45) Date of Patent: Sep. 16, 2008

(54) LED-POWERED DENTAL OPERATORY LIGHT

(75) Inventors: H. Thomas Lockamy, Charlotte, NC (US); Jason W. Spencer, Charlotte, NC (US); Daniel B. Manglicmot, Pineville, NC (US); Austin E. Unsworth, Newberg, OR (US)

(73) Assignee: Pelton & Crane, Charlotte, NC (US)

( * ) Notice: Subject to any disclaimer, the term of this patent is extended or adjusted under 35 U.S.C. 154(b) by 43 days.

(21) Appl. No.: 11/120,170

(22) Filed: May 2, 2005

(65) Prior Publication Data

US 2006/0245173 A1 Nov. 2, 2006

(51) Int. Cl.
*F21V 7/00* (2006.01)

(52) U.S. Cl. ..... 362/33; 362/247; 362/297; 362/346; 362/804

(58) Field of Classification Search ..... 362/245, 362/248, 257, 294, 800, 373, 236–238, 33, 362/804, 554–556, 572, 573, 231, 240, 244, 362/247, 251, 297, 346, 394, 304, 305, 230
See application file for complete search history.

(56) References Cited

U.S. PATENT DOCUMENTS 3,290,496 A * 12/1966 Appleton ..... 362/329
4,298,911 A * 11/1981 Headrick ..... 362/35
5,406,176 A * 4/1995 Sugden ..... 315/292
6,290,368 B1 * 9/2001 Lehrer ..... 362/187
6,478,453 B2 * 11/2002 Lammers et al. ..... 362/294
6,692,251 B1 2/2004 Logan et al.
6,955,444 B2 * 10/2005 Gupta ..... 362/105
7,275,931 B2 10/2007 Katsuda et al.
2004/0141336 A1 7/2004 West et al.
2005/0099824 A1 5/2005 Dowling et al.
2005/0158687 A1 7/2005 Dahm

OTHER PUBLICATIONS

International Search Report from PCT/US2007/080636, dated Mar. 28, 2008, 1 page.
Written Opinion of the International Searching Authority from PCT/US2007/080636, dated Mar. 28, 2008, 7 pages.

* cited by examiner

*Primary Examiner*—Bao Q Truong
(74) *Attorney, Agent, or Firm*—TraskBritt

(57) ABSTRACT

A lamp assembly adapted to cast shadow-free illumination over an area. Typically, a lamp assembly includes a plurality of light modules that are disposed in a spaced apart relationship over an area. Desirably, the lamp assembly is arranged to aim the light output of each module for overlapping summation on a target footprint. Modules generally each include a LED light source, a parabolic reflecting mirror arranged to direct light from the LED, a TIR collimating lens disposed at a distal end of the mirror, and a stray light tube disposed between the LED and a dispersing lens element.

14 Claims, 3 Drawing Sheets

LED-POWERED DENTAL OPERATORY LIGHT

BACKGROUND OF THE INVENTION

1. Field

This invention relates to apparatus that produce visible light. It is particularly directed to an electrically powered light source including a light emitting diode (LED), which is adapted for use in a dental operatory.

2. Background

It has been known for an extended period of time that electricity may be harnessed to create visible light. Incandescent light emitting elements powered by electricity have been used for substantially the same period of time. However, such incandescent lights suffer from an inefficient conversion of electricity to visible light. The inefficient conversion process causes production of a considerable amount of heat, and emission of a significant amount of radiation in, or near, the infrared spectrum. Such infrared emission inherently casts a heat load onto a target along with an illuminating beam. The heat generated by incandescent lighting may sometimes place an undesirable burden on environmental control systems, such as cooling systems used in dwellings. Both the inefficient conversion process, and removing the undesired heat load from the area near the light, lead to a correspondingly larger than necessary electric utility bill. Furthermore, in use on an operatory to illuminate an operating site on a patient, the infrared emissions may undesirably dry illuminated tissue, or may produce a feeling of discomfort in the patient.

Alternative light emitting elements include fluorescent light bulbs. Such fluorescent bulbs advantageously produce a reduced heat load compared to incandescent bulbs. However, fluorescent bulbs tend to be bulky, and generally produce light of a less desirable color and intensity for many applications. Furthermore, certain electrical components required in the electric circuit powering the fluorescent bulbs, such as the ballast, tend to produce an undesirable amount of noise. In use in an operatory, it is generally desired to reduce the bulk of a lamp fixture, to reduce its intrusion into the operating arena, and to facilitate ease of manipulation of the lamp fixture.

It would be an improvement to provide a more energy-efficient lamp fixture capable of producing a reduced heat load, and casting substantially shadow-free illumination having a desirable color and intensity.

SUMMARY OF THE INVENTION

The present invention provides an LED-powered light source particularly adapted for use in a dental operatory. However, the light source of the invention is not limited in application to dental operatories. It finds exemplary use in other medical operatories, or in industry or craft applications that benefit from employment of a light source capable of casting substantially shadow-free illumination over an area, or of a visible light source having a reduced power consumption and/or heat output.

The light source structures of this invention will ordinarily be embodied as a lamp assembly. Such assemblies typically include a housing adapted to support one or more bulbs, modules, or comparable light-emitting components. The housing will often include various mechanical and/or electronic control components. In any case, light is typically directed or reflected from the housing through an opening or lens. The portion of the lamp closest to the illumination target in use is conventionally referred to as the "front" of the lamp. Light is thus regarded as emanating from the front of the lamp.

The instant invention may be embodied to provide one or more of a variety of improvements over conventional illuminating lamp structures having incandescent light sources. A lamp structured according to the instant invention can be fashioned to provide illumination within a band selected from within a wide range of color temperatures. Certain such lamps may be further structured and arranged to permit selected varying of the color temperature of the emitted light. A lamp of this invention may be configured to permit a virtually infinite intensity adjustment of its output light (e.g., 0 to 2500 FC or more). Certain embodiments of the invention provide illumination of a target area without producing any significant amount of stray light. A dental patient's eyes can thus be spared the irritation normally associated with the stray light from an illuminating device of sufficient intensity to illuminate fully the patient's mouth in the target region of a lamp.

For most applications, the illuminated target region is considered to have an approximately flat footprint and a depth normal that footprint. That is, the illuminated region is generally structured to encompass a volume disposed proximate the footprint effective to illuminate 3-dimensional structure, such as a dental patient's oral cavity (a "target"). For purpose of this disclosure, the illuminated region (within which a "target" is located) may be viewed as a volume defined by a "footprint" (e.g., the illuminated area of a table top or wall) and the illuminated space directly adjacent the footprint. The lamp that is casting the illumination can, for convenience, be imagined to be aimed at a vertical surface, such as a wall. However, such reference is for convenience of description only, and the lamp may be aimed or otherwise oriented in space as desired, with corresponding changes made to the shape or orientation of the illuminated footprint. A footprint might encompass any shape, including rectangular, oval, circular, or irregular.

The preferred light sources (one or more high-powered LEDs emitting radiation having one or more wavelengths in a visible spectrum) inherently possess a long life, which reduces maintenance requirements in a lamp. The spectrum of emitted light from a lamp can be fixed in a range to reduce emitted UV wavelengths, thereby affording improved working time for a clinician to work with UV-cured adhesives or composites. The emitted light from certain desirable LED sources inherently has a reduced component of waves near the infrared spectrum, thereby resulting in greatly reduced heat output from the front of the lamp. The reduced heat output enhances a dental patient's comfort while that patient is in the illuminated target area of a lamp, and reduces tissue drying (e.g., in a medical operatory).

LED light sources may be selected for their emitted spectrum, and mixed in combination within a lamp to produce a desired lamp output intensity and/or color. Different color LEDs may be disposed at selected locations in a lamp to form, in combination, a lamp output having a certain color. The intensity of the lamp's output can, in some cases, be controlled by use of a microprocessor. Of course, a variable number of LED-powered visible light sources may simply be turned on at one time alternatively to control a lamp's output intensity and/or color.

A further advantage provided by certain desirable LED light sources is their reduced power requirement. A lamp including one or more LED-powered light source draws a reduced amount of electricity to generate a similar amount of light output compared to an incandescent lamp of similar intensity. Because the conversion of electric power to visible light is efficient in an LED light source, the heat generated in that process is reduced compared to incandescent light sources. Therefore, a lamp constructed according to the invention produces a reduced heat load on the environment in which that lamp is placed. A correspondingly reduced strain is thereby placed on environmental control facilities, such as a local air conditioning system. The reduced electricity consumption of the LED-powered lamp results in a direct reduction in a user's electricity cost. Current estimates are that an LED powered lamp will replace a comparable-intensity incandescent lamp at an approximately 60% reduction in power consumption.

A lamp constructed according to the instant invention typically incorporates a combination of one or more high powered LEDs that form one or more light emitting source. Desirably, at least for dental applications, the emitted light produces an elliptical-shaped, shadow-reduced, light pattern of variable intensity and color temperature. When a plurality of light sources is provided, it is generally preferred to arrange their respective outputs to produce an overlapping feathered-edge pattern. This expedient offers several benefits, particularly the reduced likelihood of eye fatigue of a clinician or other user.

The improved LED-powered lamps may be manufactured to permit making adjustments in a focus length between a lamp and a target area. Adjustments may be provided also to control the shape of the illuminated pattern at different focus distances. Other ease-of-use features desirably are included, such as forming the lamp to facilitate maintenance. One such feature is providing a lamp with a hinged portion of the housing or back (or lens area), to permit ready access to replace or maintain the light source(s).

Preferred dental lamps constructed according to the invention are shaped and dimensioned to permit an operator and an assistant to move in close to a patient's oral cavity without obstructing the operating area with shadows. It is further desirable that the lamp be structured and arranged to occupy a nonintrusive volume. Such lamps may provide a narrow vertical shape at the lamp body, and orient or focus the LED light source's output onto an illuminated area having a reduced vertical size. In some instances, a lamp focus may be adjusted to produce either an increased or decreased horizontal size, compared to the corresponding size of the lamp.

It is within contemplation that a variety of LED light sources, each source providing one or more color, wavelength spectrum, or intensity, may be combined in a lamp. In certain currently preferred embodiments adapted for dental use, a plurality of individual reflector modules, each containing an LED light source, are mounted on a lamp structure to shape and direct the emitted light toward a target. The reflector modules can be pitched or tilted to focus their emitted light toward a desired target. For example, in one currently preferred embodiment, a plurality of LED-powered reflector modules are arranged in an arcuate array and oriented to aim their individual light beams to provide shadow-free impingement on a region with a footprint having a reduced area compared to the area of the front of the lamp.

In one alternative lamp construction, light output from one or more LED source is directed rearward for reflection from a curved or faceted interior surface of lamp structure to focus on a target area at a distance from a front portion of the lamp. A lamp structured for use in the dental environment might produce an illuminated target area of about 3 inches high by about 8 inches wide at a distance of about 18 to 36 inches from the lamp front. The LED source itself can sometimes function as a self-contained reflector module. Another alternative construction disposes a plurality of LED light sources in an arcuate, or other-shaped, distribution to focus emitted visible light forward toward a target area located at a distance from the front of the lamp. In the latter construction, lamp structure holding the LED light sources can sometimes also operate as a reflector surface to direct certain emitted light in a forward direction.

In certain embodiments of the invention, the light output of a plurality of LED light sources, arranged in individual reflector modules and focused toward a target, can be transmitted through a refractor lens positioned at a front of a lamp and operable to create a light pattern and color temperature on the target. Operable lenses may provide converging and/or mixing of the output from the individual light sources. Certain operable such refractor lenses are multifaceted. Functional lenses may range from simple translucent coverings having no significant effect on transmitted light, to complexly arranged members operable significantly to effect a propagation direction, or physical quality, of transmitted light. In some instances, a plurality of individual lenses may be concatenated to form a single lamp lens. Lenses may be clear, or may modify a color in the transmitted light.

Embodiments of a lamp manufactured according to principles of the instant invention need not include a front lens. However, in use in an environment such as a dental operatory, it is preferred to provide a front lens as a protective cover to block migration of dust and contaminated aerosols into the lamp interior. A front surface of such a lens may be structured to provide an easily cleanable surface, whereby to maintain sterility of the operatory area. Whether or not a focusing lens is provided, a shield made from LEXAN®, or other similar material, desirably is provided to completely encase the front of a dental lamp to resist contamination of, and to facilitate cleaning of, the lamp. Furthermore, it sometimes is desirable to provide a scratch-resistant ceramic frit.

In one currently preferred embodiment of the invention, a lamp is formed to replace a commercially available dental operatory lamp. The improved lamp provides equal or higher light output to, and retains the basic light pattern of, the commercially available lamp. Therefore, a user may not notice a substantial change in performance when changing to the improved lamp. In fact, the improved lamp can provide one or more features to even enhance that user's experience. Desirably, the improved dental lamp is free from stray light, and has a temperature of the projected light that is variably adjustable in color from, e.g., about 3600K or less, to, e.g., about 4200K, and in some instances up to about 5000K or more. Lamps having a fixed color output are also within contemplation.

LED-powered dental lamps desirably are variably adjustable in intensity. A practical range is currently considered to range from about 1500 foot-candles, to about 2000 foot-candles, and more advantageously up to about 2500 foot-candles, or more, at a distance of about 27 inches from the lamp.

The low heat output of the improved lamp enhances comfort of the patient and clinician—both by projecting a lower heat load onto a patient, and by providing a cooler lamp housing. It is currently preferred to use high-intensity LED sources, although low-intensity sources are also workable. Typical LED sources used in the invention are efficient at producing primarily visible light output and low heat at low applied voltages. In use, the improved lamp typically provides a cool front portion and a warm rear portion. The lamp's housing generally is constructed to convey any heat produced by the LED source(s) to the room by convection and radiation. An exemplary lamp housing typically includes a metal, or other heat-conducting material, arranged at a rear portion of the lamp to dissipate such heat output away from the lamp and patient.

BRIEF DESCRIPTION OF THE DRAWINGS

In the drawings, which illustrate what are currently regarded as the exemplary modes for carrying out the invention.

DETAILED DESCRIPTION OF THE ILLUSTRATED EMBODIMENTS

Figure 1:
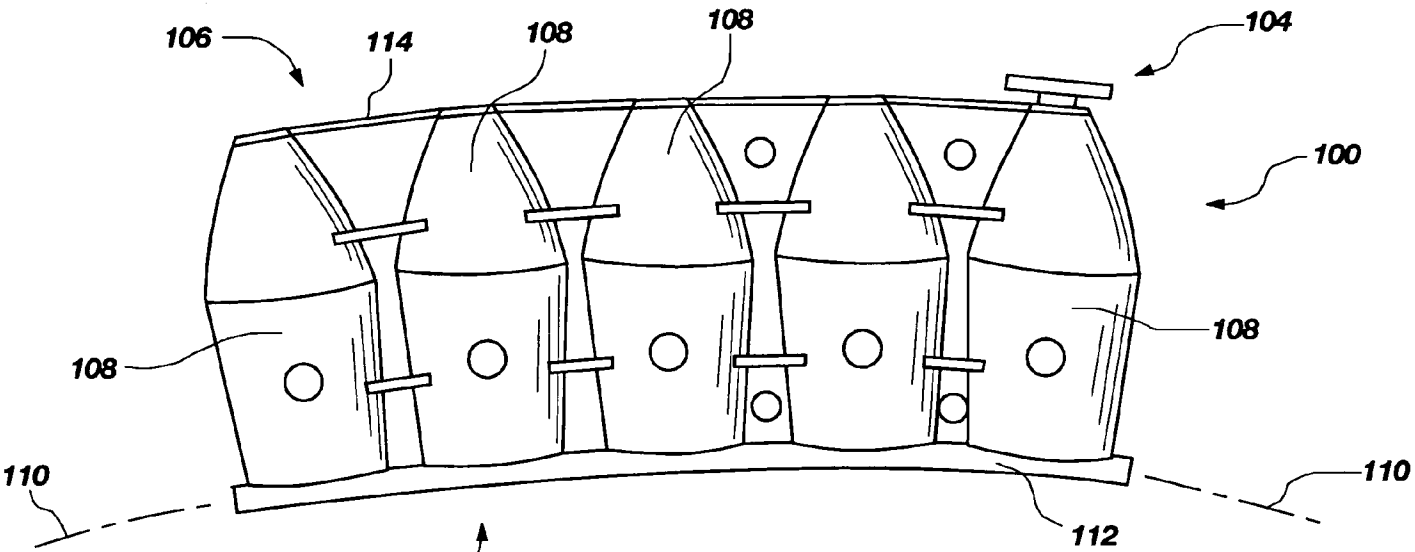
FIG. 1 is a side view representation of a dental operatory lamp constructed according to principles of the invention.

FIG. 1 illustrates a side view of a currently preferred embodiment, generally indicated at 100, of a light source structure constructed according to principles of the invention. Light source structure 100 may generally be characterized as a lamp. Lamp 100 is powered by electricity, and functions to provide illumination to a work area disposed a distance from the lamp front, generally indicated at 102. Desirably, the work area illuminated by lamp 100 is shadow-free, and appears relatively uniform in illumination color and intensity. For most applications, the illuminated target work area is considered to have an approximately flat footprint and a depth normal to that footprint. That is, the illuminated region is generally structured to encompass a volume disposed proximate the footprint.

Illustrated lamp 100 includes attachment structure, generally indicated at 104, operable to connect lamp 100 to suspension structure in the work area. Illustrated attach structure 104 is carried at a back 106 of lamp 104, although any convenient arrangement is operable. Typical suspension structure in a dental operatory permits a user to orient the lamp in space operably to aim the light output of lamp 100 at the desired target area. Certain embodiments of the invention provide a lamp having reduced weight and/or intrusive volume compared to commercially available lamps. Such reduced weight lamps permit a corresponding reduction in mass of the lamp suspension arrangement, thereby increasing ease of manipulation of the lamp to orient its output toward a target.

Lamp 100 includes a plurality of light modules 108 disposed in an array and tilted along an arcuate path 110 to aim their collective light outputs to impinge on a desired target footprint. Illustrated light modules 108 are sometimes also called reflective modules. One row of modules 108 is visible in FIG. 1, although any number of such rows may be repeated in a columnar, staggered, or other arrangement in space to form a 3-dimensional lamp body providing the desired luminescent output.

One currently preferred lamp assembly 100 includes 3 rows forming 5 columns of modules 108, for a total of 15 modules in the lamp. Such modules 108 are desirably spaced apart from each other and aimed in harmony to form a shadow-free illumination of a target region. In the context of this disclosure, the term "shadow-free" means that an object, such as a tool or a user's hand, casts essentially no shadow when placed between the lamp and its illuminated target. It is currently preferred for an output of each module to be shaped to substantially illuminate the entire target footprint. Therefore, the target footprint is fully illuminated by the sum of the outputs of modules 108. In such an arrangement, an object blocking light emitted by one, or even most, of the modules 108 still would not cast a shadow on the target footprint. A path along a column between rows may be a straight line, although it is currently preferred that such path (not illustrated, but similar to path 110) also is arcuate.

In use in an environment such as a dental operatory, it is preferred to provide a front shield 112 as a protective cover to block migration of dust and contaminated aerosols into the lamp interior. A front surface of such a shield 112 may be structured to provide an easily cleanable surface, whereby to maintain sterility of the operatory area. In certain embodiments, shield 112 may incorporate one or more lenses to focus, or otherwise modify, the light output of lamp 100. Whether or not a focusing lens is provided, a shield made from LEXAN®, or other similar optically useful and formable material, desirably is provided to completely encase the front of a dental lamp to resist contamination of, and to facilitate cleaning of, the lamp. Illustrated shield 112 is injection molded, and includes focusing lenses for each of the modules 108 in a unitary part. Desirably, shield 112, or a portion of lamp housing 114, is hinged, or otherwise openable by a user, to provide access to the interior of lamp 100 for maintenance or replacement of a light generating element.

Figure 2:
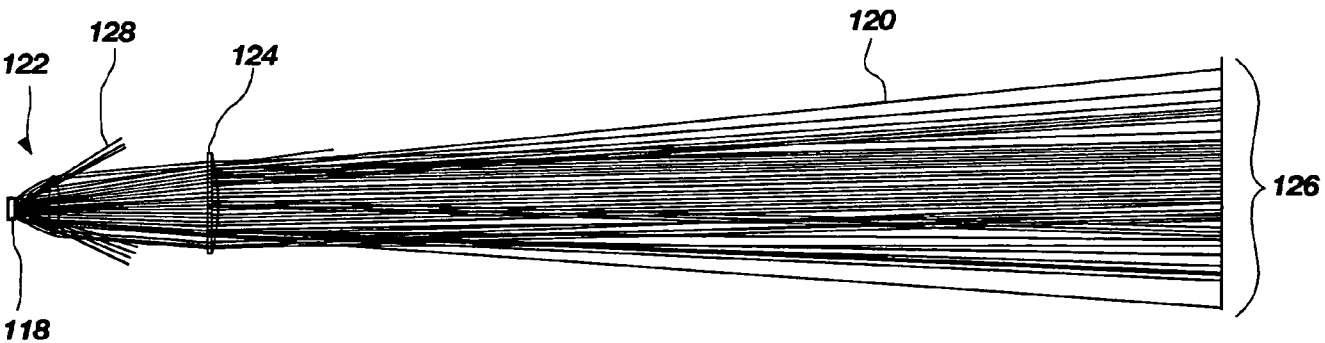
FIG. 2 illustrates a component arrangement and a corresponding light output for a module.

With reference to FIG. 2, an LED 118 emits light indicated by a plurality of rays 120. An operable LED includes a 3 watt LED such as that sold by Lumileds Lighting US, LLC under the Brand name Luxeon, part number LXHL-LW3C.

Typically, a reflective element, generally indicated at 122, is provided to direct the LED's light output toward a target. A focusing lens 124 124 may be included in an arrangement effective to collimate rays 120, and further direct them to an illuminated area indicated at 126. In certain embodiments of the invention, area 126 corresponds to the target footprint of the lamp 100. In such case, it is desired that the illumination emitted from each module 108 is substantially uniform over area 126. Certain rays 128 may be emitted in a direction other than desired for impingement on area 126. Such rays 128 are characterized as stray light. As indicated by the illustrated collection of rays 120, area 126 sometimes has a higher intensity of illumination at its center, and may fade to a decreased intensity near its perimeter. In another embodiment, the LED 118, mirror 122, and all associated optics are arranged in harmony to produce a substantially uniform intensity over its illuminated footprint at a selected focal distance.

Figure 3:
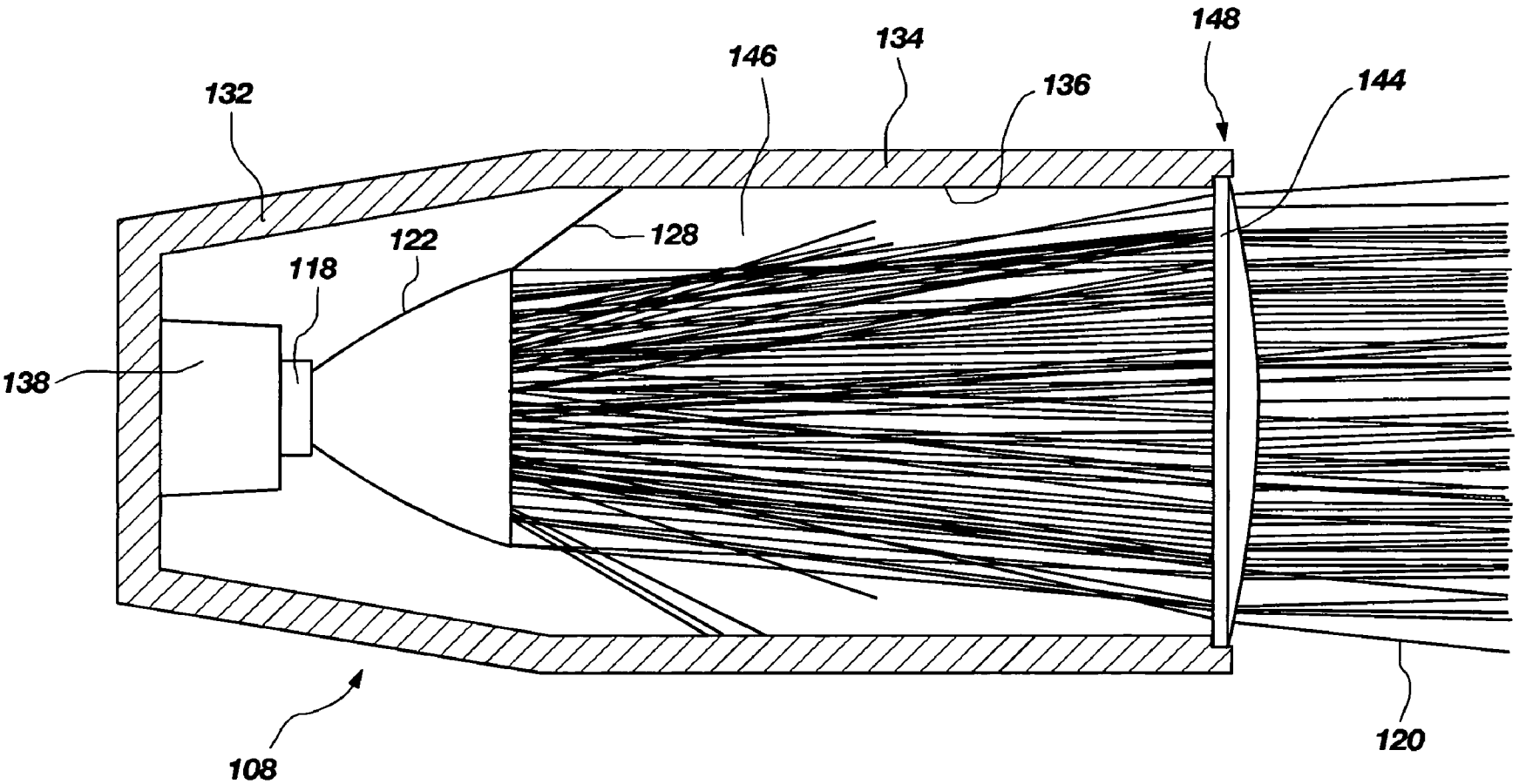
FIG. 3 is a cross-section taken along an axis of a light module constructed according to principles of the invention.

Another exemplary light module 108 is illustrated in FIG. 3. Housing 132 of illustrated module 108 includes a portion that forms a component stray light tube 134. An interior surface 136 of tube 134 may be reflective, but desirably is arranged to resist reflection of incident stray light rays 128 to reduce emission of such stray rays outside the target footprint. A preferred stray light tube 134 provides a black, or essentially light absorbing, surface 136 to resist reflection of stray light rays 128. It is within contemplation for a stray light tube 134 to be formed as a distinct component. However, including the stray light tube as a portion of the housing 132 reduces part count and cost, and simplifies assembly of a lamp 100.

LED 118 is typically mounted with respect to housing 132 by a conveniently structured foundation 138. Desirably, foundation 138 is structured to provide simple and rapid installation and removal of LED 118, and includes connection structure for the electricity supplied to the LED. It is further desirable for foundation 138 to be formed from a material capable of conducting heat. Advantageously, foundation 138 and housing 132 may be structured and arranged to dissipate any heat generated by LED 118 in a direction away from the front of the lamp 100.

Lens 144 may be arranged to disperse, focus, collimate, color, or otherwise modify a characteristic of light 120 passing therethrough. Alternatively, or in addition, lens 144 may be configured as a protective shield for a module 108, or lamp 100. In certain cases, a collimating lens may be disposed in the space 146 located between LED 118 and a distal end 148 of module 108. Desirably, such collimating lens is placed in proximity to the discharge opening of the parabolic reflector 122 to reduce a length of the light module 108. In a currently preferred embodiment of lamp 100, modules 108 are about 2½ inches in length, and approximate the size in a thickness direction of the lamp 100.

Figure 4:
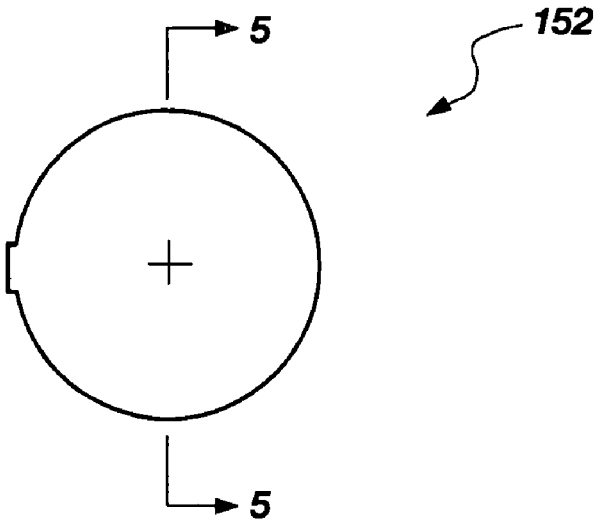
FIG. 4 is an end view of a first collimating lens used in certain embodiments of the invention.
Figure 6:
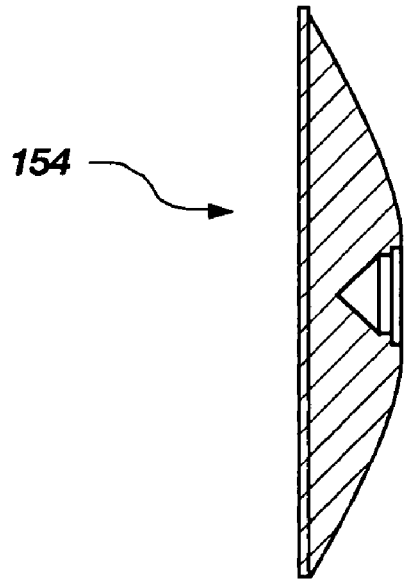
FIG. 6 is a cross-section, similar to FIG. 5, taken through a second, alternative, collimating lens.
Figure 5:
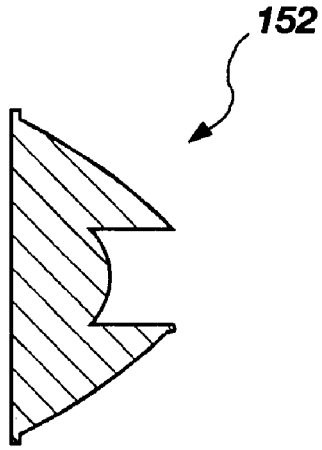
FIG. 5 is a cross-section taken through section 5-5 in FIG. 4 and looking in the direction of the arrows.

FIGS. 4-6 illustrate configurations of collimating lenses of use in certain embodiments constructed according to principles of the invention. Such lenses typically are structured to direct the LED's light output toward a target, and permit formation of lamp 100 in a compact form factor. A pair of operable collimating lenses, configured as TIR lenses, is illustrated in FIGS. 4-6. The first collimating TIR lens 152 (<4.5 deg. FWHM) is illustrated in end and section views in FIGS. 4 and 5, respectively. The second TIR lens (<2 deg. FWHM), illustrated in cross-section in FIG. 6 and is generally indicated at 154. Such lenses permit a reduction in length of the stray light tube or equivalent portion of a housing 132.

Lenses are designed in accordance with known optical parameters, including the relations set forth in Table 1. It is currently preferred to injection mold lenses from LEXAN®, or other optically effective plastic material.

TABLE 1

| |
|---|
| Optical Power (single element) |
| Phi = (n' − n)C = (n' − n)/R |
| C = 1/R |
| f = fE = 1/phi |
| fF = −n/phi = −eta*fE |
| fE = −fF/n = f'R/n' |
| fR' = n'/phi = n'fE |
| fR'/fF = −n'/n |
| Field or spot size limited by the f/# of the optical element: |
| z = −(1 − m)/m*fF |
| z' = (1 − m)/fR' |
| Magnification factor: |
| m = −(z'/z)*(fF/fR') |
| fR'/z' + fF/z = 1 |

What is claimed is:

1. A dental operatory lamp used in an operating theater to illuminate over an operating area comprising:

a housing having a front directed toward the operating area and a rear away from the operating area;

at least one reflector module at the rear of the housing comprising a plurality of tubes arranged in generally side-by-side configuration, each tube having a first end of each tube being positioned toward the rear of the housing and being closed by a reflector and a second end of each tube being open to the transmission of light from the interior of the tube toward the front of the lamp, with the interior surface of the plurality of tubes between their reflectors and second ends being generally non-reflective; and a plurality of light emitting diodes (LEDs), one of the LEDS being positioned in each of the tubes, and a portion of the respective tube projecting forward of the LED toward the front of the lamp.

2. The lamp of claim 1, wherein the plurality of tubes are positioned with their longitudinal axes aligned toward predetermined points within the operating area for directing the light from the plurality of LEDs toward the front of the lamp in a pattern that casts illumination over the operating area.

3. The lamp of claim 1, further comprising a plurality of lens in the tubes, with at least one lens per tube located at the open end thereof for directing the light from the plurality of LEDs toward the front of the lamp in pattern that casts illumination over the operating area.

4. The lamp of claim 1, further comprising a lens member at the front of the lamp presenting a plurality of individual lens sections over a face thereof arranged in a pattern corresponding to the position of the plurality of tubes, each lens section being aligned with a respective tube for directing light from the LED in that tube toward the front of the lamp in a pattern that casts illumination over the operating area.

5. The lamp of claim 1, wherein the at least one reflector module is arranged in an arcuate array.

6. The lamp of claim 1, wherein the at least one reflector module comprises a plurality of reflector modules arranged in rows.

7. The lamp of claim 1, further comprising a refractor lens disposed at the lamp front to create a light pattern and color temperature on a target.

8. The lamp of claim 1, further comprising a collimating lens disposed between the at least one LED and a distal end of the at least one reflector module.

9. A dental operatory lamp used in an operating theater to illuminate over an operating area comprising:

a housing having a front directed toward the operating area and a rear facing away from the operating area;

a plurality of stray light tubes having an interior anti-reflective surface to reduce emission of stray rays outside a target footprint; and a plurality of light emitting diodes (LEDs), at least one LED for each stray tube, with each LED being positioned in the respective stray light tube, wherein the stray light tube forms a portion of a reflector module located at the rear of the housing wherein the reflector module comprises a pluraliy of tubes arranged in generally side-by-side configuration with an LED being positioned in each of the tubes.

10. The lamp assembly of claim 9, wherein the stray light tube comprises a light absorbing surface.

11. The lamp assembly of claim 9, further comprising a collimating lens disposed between at least one LED and a distal end of the stray light tube.

12. The lamp assembly of claim 9, wherein the plurality of stray light tubes are positioned with their longitudinal axes aligned toward predetermined points within the operating area for directing the light from the plurality of LEDs toward the front of the lamp in a pattern that casts illumination over the operating area.

13. The lamp assembly of claim 9, further comprising a plurality of lens in the stray light tubes, wherein each of the plurality of lens for each stray light tube are located at an open end thereof for directing light from the LEDs toward the front of the lamp in a pattern that casts illumination over the operating area.

14. The lamp assembly of claim 9, further comprising a shield to cover at least a portion of the lamp front, wherein the shield comprises focusing lenses positioned over the shield corresponding to the stray light tubes.

* * * * *

UNITED STATES PATENT AND TRADEMARK OFFICE

CERTIFICATE OF CORRECTION

PATENT NO. : 7,425,077 B2
APPLICATION NO. : 11/120170
DATED : September 16, 2008
INVENTOR(S) : H. Thomas Lockamy et al.

It is certified that error appears in the above-identified patent and that said Letters Patent is hereby corrected as shown below:

On the title page:

| | |
|---|---|
| In ITEM (73) Assignee: | change "**Pelton & Crane**, Charlotte, NC (US)" to --**Dental Equipment, LLC**, Charlotte, NC (US)-- |
| COLUMN 5, LINE 41, | change "lamp 104," to --lamp 100,-- |
| CLAIM 3, COLUMN 8, LINE 7, | change "in pattern" to --in a pattern-- |
| CLAIM 13, COLUMN 8, LINE 56, | change "tube are located" to --tube is located-- |

Signed and Sealed this

Seventh Day of September, 2010

David J. Kappos

David J. Kappos
*Director of the United States Patent and Trademark Office*